United States Patent [19]

Rubashev et al.

[11] 4,135,126

[45] Jan. 16, 1979

[54] DEVICE FOR NONCONTACT SWITCHING OF LOADED TRANSFORMER TAPPINGS

[76] Inventors: Grigory M. Rubashev, V.O. 15 Linia, 34, kv. 37; Stanislav N. Starostin, Bolsheokhtinsky prospekt, 10, korpus 1, kv. 106; Vitaly E. Pojurovsky, ulitsa Reshelnikova, 17, kv. 36; Olga N. Gruzova, Tikhoretsky prospekt, 17, korpus 5, kv. 4, all of Leningrad, U.S.S.R.

[21] Appl. No.: 766,919

[22] Filed: Feb. 9, 1977

[51] Int. Cl.[2] ..... G05F 1/20

[52] U.S. Cl. ..... 323/43.5 S

[58] Field of Search ..... 323/44, 43.5 S, 91

[56] References Cited

U.S. PATENT DOCUMENTS 3,437,913 4/1969 Matzl ..... 323/43.5 S 3,534,246 10/1970 Matzl ..... 323/43.5 S 3,909,697 9/1975 Depenbrock ..... 323/43.5 S

FOREIGN PATENT DOCUMENTS 1277437 9/1968 Fed. Rep. of Germany ..... 323/43.5 S

*Primary Examiner*—Gerald Goldberg

*Attorney, Agent, or Firm*—Lackenbach, Lilling & Siegel

[57] ABSTRACT

The invention discloses a device for noncontact switching of loading transformer tappings, and includes bridge rectifiers built around controlled and noncontrolled semiconductor elements and connected to the transformer tappings whose number is equal to that of the number of voltage steps; the device, including switching thyristors inserted in the diagonals of the bridge rectifiers and at least one LC-circuit connected to the terminals of the bridge rectifiers.

3 Claims, 5 Drawing Figures

DEVICE FOR NONCONTACT SWITCHING OF LOADED TRANSFORMER TAPPINGS

The present invention relates to switching systems and more particularly, to devices for noncontact switching of loaded transformer tappings.

Such devices can be used in electric power supply systems for controlling the voltage, especially where vigorous requirements are imposed on the speed of response of the switching gears and on the shape of the output voltage curve. Such a device can find wide application for controlling the voltage of commercial transformers, for controlling the input power of electric-arc and electrothermic furnaces, for stabilizing the voltage of welding apparatus, lighting loads, stands for radio equipment adjustment, power supply sources of computer centers, electric drives, etc.

The development of static switching devices for noncontact switching transformer tappings is an important problem, the solution of which is vital for various branches of industry.

The first attempts in applying such devices for adaptation, mainly on transformers having low and medium power outputs, were made by using bipolar groups of thyristors connected to transformer tappings as static commutators. There are known three types of switching by means of bipolar groups: switching through "zero current", switching through " no-load operation" and switching through a "short circuit".

The disadvantage of all switching devices using bipolar groups consists in their low reliability caused by the necessity in continuous control of the bipolar group during normal operation of the transformer. The low reliability also stems from the switching principle itself. When using the "zero current" switching principle, the commutation is effected by applying control pulses to the operating group of thyristors at the moment of zero load current. In this case the device requires a complex algorithm of the control system, since the latter must follow the phase of the load current. An error in determining the switching moment can result either in a short circuit of the controlled stage or in a break in the main load network and, therefore, in overvoltage.

When using a "no-load" switching principle, the group of thyristors is put into operation at the expense of the energy of the recovering voltage across the output group, after the current has passed through zero. In this case the control algorithm is simplified. However, overvoltages are also possible when the control system operates with a delay.

The devices using the "short-circuit" switching principle must be provided with additional bipolar groups of thyristors for switching the current limiters on and off and a reactor or resitor after the switching operation.

Medium-power and high-power transformers are presently equipped with switching devices comprising an electromechanical selector and a thyristor commutator within a tapping. USSR Inventor's Certificate No. 370598 and BRD Pat. No. 1803741 are examplary of such a realization.

BDR Pat. No. 1803741 is the closest prototype of the present invention. The switching apparatus in accordance with BDR Pat. No. 1803741 comprises a tapping selector made in the form of an electromechanical switch. The apparatus can perform switching of the tappings located at the zero terminal of the transformer and the tappings located in the centre of the phase winding of the transformer; the apparatus makes it possible to improve the spark-extinguishing properties of the switch contactors due to application of thyristor switches inserted into the d-c diagonal of the noncontrolled rectifiers and also makes it possible to perform artificial transfer of electric current between the tappings.

Disadvantage of the technical solution disclosed in BDR Pat. No. 1803741 reside in its low speed of response and insufficient reliability due to the presence of an electromechanical switch.

An object of the present invention is to provide a completely noncontact switching device having a high speed of response and high reliability, as well as minimum power requirements, of the switching elements.

Another object of the invention is to provide reliable switching independent of the nature of the load at an arbitrary moment.

Another object of the invention is to provide reliable switching action between any two tappings including switching through one tapping or through several tappings.

Still another object of the invention is to provide the possibility of connection of the device to an arbitrary scheme of location of tappings on the transformer windings.

These objects are attained by the proposed device for noncontact switching of transformer tappings, which device comprises a switch consisting of bridge rectifiers connected to the transformer tappings, the number of rectifiers being equal to the number of tappings. Inserted into the d-c link of these rectifiers are switching thyristors which are forcedly switched by at least one LC-circuit connected to the rectifier terminals.

The device of the invention can be used with three-phase transformers having tappings at the zero terminal side.

In this case the bridge rectifiers built around noncontrolled rectifiers are connected in a three-phase bridge circuit, connected to the corresponding windings of the three phases of the transformer. Switching thyristors are inserted in the d-c diagonals of the bridge rectifiers. The like terminals of the bridge rectifiers are interconnected through LC-circuits.

Thus, the switch of the given design is featured by individual switching circuits.

The objects of the invention can also be accomplished by the provision of a device with a common switching circuit.

In this case the bridge rectifiers are built around a three-phase bridge circuit with noncontrolled rectifiers, switching elements being inserted in the d-c diagonals of the bridges. The common positive and negative terminals of each of the bridge rectifiers are connected to groups of auxiliary rectifiers, the positive and negative terminals of the auxiliary rectifiers being combined and connected to a common LC-circuit shunted by an additional thyristor.

When the transformer tappings are located in the center of the winding, the objects of the invention can be attained by making the switch in the form of two groups of bridge rectifiers based on a single-phase bridge circuit having switching thyristors inserted in the d-c diagonals of said rectifiers LC-circuits are connected between the positive and negative terminals of said bridge rectifiers, each group of bridge rectifiers having two arms based on noncontrolled rectifiers and common for the whole transformer and two arms based on thyristors to be connected in turn to the transformer tappings.

Such constructional arrangement of the device makes it possible to realize a number of advantages of the switch, namely; the switching device does not require application of control pulses on the potential under normal operating conditions, and the device is made completely of noncontact static elements and features high reliability. The devices of this type are characterizd by high speed of response and can operate at a frequency higher than the mains frequency. Any regulation intensity can be provided. The devices are suitable for performing switching operations through any arbitrary number of steps and can be used with transformer windings with any arrangement of tappings.

All these advantages ensure high technical and economical efficiency provided by a high-speed and reliable switch which can also be used in various process units. It should be emphasized that a significant economic effect can be obtained where it is necessary to perform high-speed control without distorting the shape of the output voltage, which makes it possible to improve the power characteristics of electrical installations (welding, electric drive, stands for adjusting radio equipment, electric furnaces, etc.).

The invention will be better understood from the following detailed description of embodiments thereof, taken in conjunction with the accompanying drawings, in which.

Figure 1:
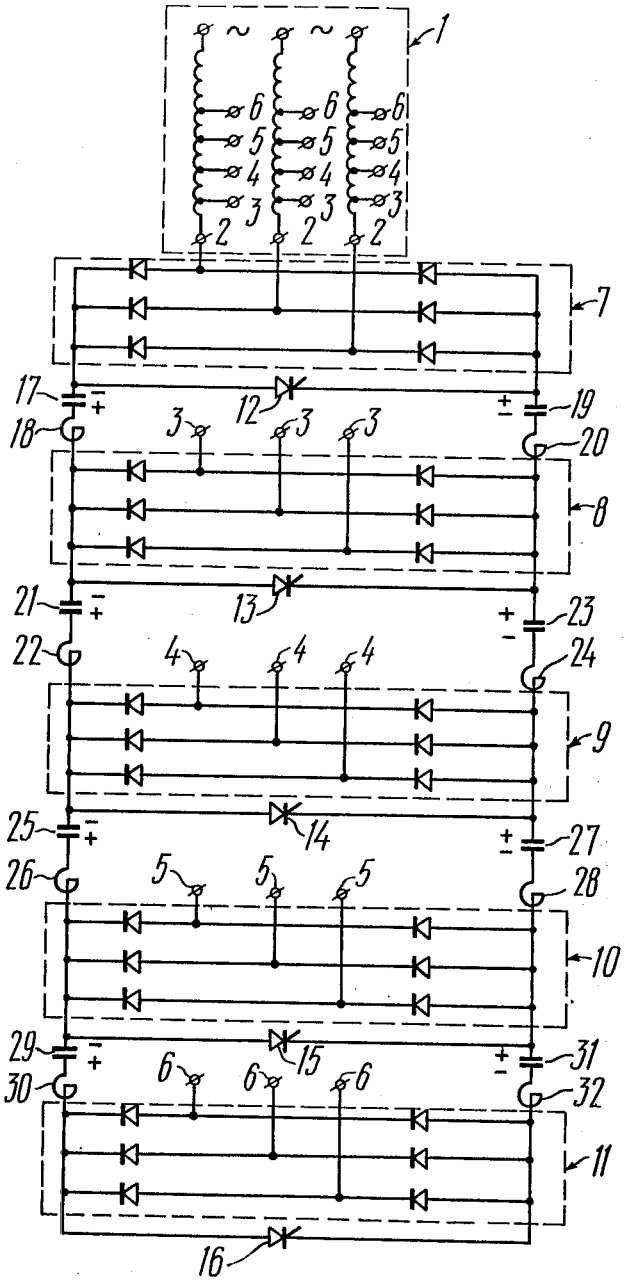
FIG. 1 shows an embodiment of the invention with individual switching circuits.

Referring now to the above drawings, FIG. 1 illustrates a transformer 1 whose phase windings have, for example, five tappings 2–6 at the zero terminal side. These tappings are connected to five noncontrolled bridge rectifiers 7–11 having thyristors 12–16 inserted into the d-c diagonals of said rectifiers. The positive and negative terminals are interconnected through LC-circuits 17–18, 19–20, 21–22, 23–24, 25–26, 27–28, 29–30, 31–32, respectively.

The device of the invention operates as follows.

Before a transformer 1 is connected to the mains, a control signal is fed to the thyristor 12; then the transformer is connected to the mains. In this case the transformer 1 has minimum input voltage, since its zero output is connected at the level of a tapping 2. Capacitors 17, 19, 21, 23, 25, 27, 29, 31 are charged through bridges 8, 9, 10, 11 via the corresponding circuits. For example, the capacitors 17, 19 are charged through the following circuit: the bridge rectifier 8, reactor 18, thyristor 12, and the reactor 20. The other capacitors are charged in a similar way and they acquire the polarities shown in FIG. 1 — the switch is ready for operation.

Under normal operating conditions the zero point of the transformer 1 is built around one of the operating thyristors 12–16, which is in the d-c circuit and does not require control from the ground potential. In order to transfer the system to another tapping, for example to a tapping 3, a single control pulse is applied to the thyristor 13. The capacitors 17, 19 are discharged through the following circuit: the reactor 18, thyristor 13, reactor 20, capacitor 19, thyristor 12, and capacitor 17. When the current of the thyristor 12 drops down to zero, further discharge is effected through the rectifiers of the bridge 7. After the valve properties of the thyristor 12 have been restored, the capacitors 17, 19 are recharged through the mains and the rectifier 7. The polarity of the capacitors 17, 19 is reversed as compared to that shown in FIG. 1. The zero point of the transformer is connected at the level of the tapping 3. For returning to the tapping 2, it is sufficient to apply a control pulse to the thyristor 12. The network is reswitched in a similar way.

The proposed switching device provides for switching between any two tappings. For example, transition from the tapping 3 to the tapping 6 is effected by applying a single control pulse to the thyristor 16. In this case the thyristor 13 is switched off by the discharge current of the switching capacitors 21, 23, 25, 27, 29, 31, which are connected in series with each other in the following circuit: the capacitor 21, reactor 22, capacitor 25, reactor 26, capacitor 29, reactor 30, thyristor 16, reactor 32, capacitor 31, reactor 28, capacitor 27, reactor 24, capacitor 23, and the thyristor 13. After that, the capacitors 21, 23, 25, 27, 29, 31 are recharged through the corresponding bridge rectifiers 8, 9, 10. The reactors 18, 20, 22, 24, 26, 28, 30, 32 restrict the increasing rate of the current through the switching thyristors. In a similar manner, we may follow the cycle of transition from any one tapping to another.

The speed of response of the switch is determined mainly by the recharge time of the capacitors. With real parameters of power supply networks and transformers the switch makes it possible to commutate the tappings at a frequency exceeding that of the power supply network at a high speed of response.

Figure 2:
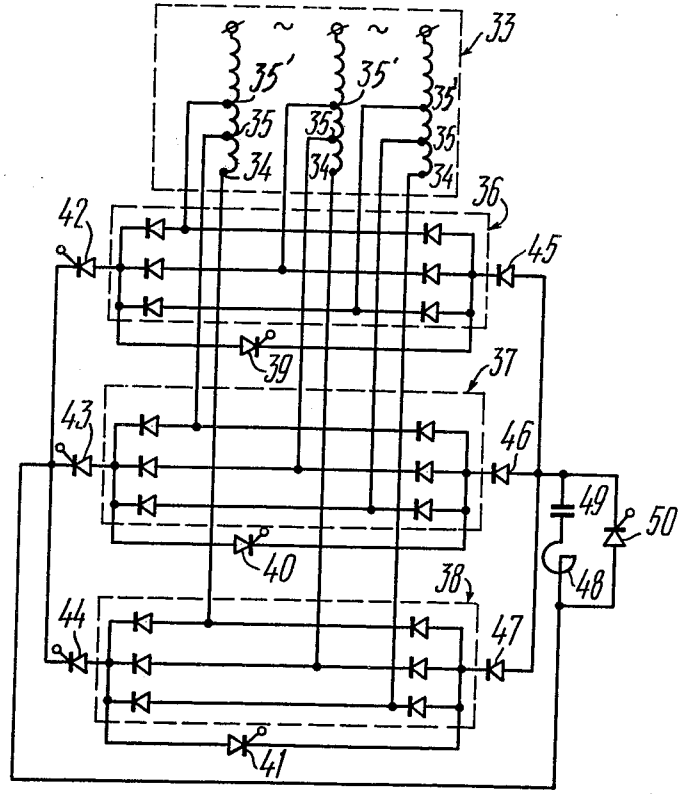
FIG. 2 shows an embodiment of the invention with a single switching circuit.

The proposed device can be based on a single switching circuit, common for all tappings. A schematic diagram of such a device is shown in FIG. 2. By way of example, the circuit is shown in connection with a three-phase transformer having three tappings at the zero terminal side. However, the circuit can be used with any number of tappings.

The device shown in FIG. 2 comprises a transformer 33 whose phase windings have tappings 34, 35, 35' connected to noncontrolled bridge rectifiers 36, 37, 38 on the d-c side of which there is connected a first group of switching thyristors 39, 40, 41. The positive terminals of the bridge noncontrolled rectifiers are connected to the anodes of a second group of switching thyristors 42, 43, 44, while the negative terminals of the rectifiers are connected to the cathodes of the noncontrolled rectifiers or diodes 45, 46, 47. The positive terminals of the second group of thyristors 39, 40, 41 and the negative terminals of the non-controlled rectifiers 45, 46, 47 are bridged through a common LC-circuit 48, 49 shunted by an auxiliary thyristor 50.

The device operates as follows.

When the transformer 33 is connected to the mains, one of the thyristors 39, 40, 41 is rendered conductive. At the same time, control signals are fed to the thyristors 42, 43, 44. In this case the capacitor 49 is charged through a corresponding circuit. If, for instance, the thyristor 39 is cut in, the capacitor will be charged through the following circuit: the positive terminal of the rectifier 38, thyristor 44, reactor 48, capacitor 49, noncontrolled valve 47, and the tapping 34 of the second phase to a voltage equal to the maximum value of the phase voltage of the whole regulation zone, when the phase voltage of the regulation zone exceeds the linear voltage of all inoperative tappings. If the phase voltage of the regulation zone is lower than the linear voltage of the tapping, the capacitor is charged through the following circuit: the tapping 34 of one phase, thyristor 44, reactor 48, capacitor 49, noncontrolled rectifier 47, and tapping 34 of the o-ther phase.

To prepare capacitor 49 and effect switching of any tapping, the capacitor 49 is recharged by switching on the thyristor 50. The capacitor 49 is recharged through the following circuit: the capacitor 49, reactor 48, and thyristor 50 to the initial voltage minus the circuit losses.

For performing switching operation, for example from the tapping 35 to the tapping 35, a control pulse is applied to the thyristor 39 and all auxiliary thyristors during the period of recharging the capacitor 49 through the following circuit: the capacitor 49, noncontrolled rectifier 46, thyristor 40, thyristor 43, reactor 48, and capacitor 49 until the current of the thyristor 40 is zero. Then the thyristor 40 is rendered nonconducting through the following circuit: the capacitor 49, noncontrolled rectifier 46, noncontrolled rectifiers of the bridge 37, thyristor 43, reactor and capacitor 49 until the capacitor is charged to the maximum linear voltage of the whole regulation zone and the transformer is switched to the tapping 36 and the thyristor 40 is rendered fully nonconductive. Thereafter, control signals are fed to all the switching thyristors 42, 43, 44 of the second group and capacitor 49 is charged to the maximum linear voltage of the regulation zone. Then, as the thyristor 50 has been switched on capacitor 49 is recharged and the switch is ready for further switching. The transformer remains connected to tapping 36, since thyristor 39 is cut in the d-c link of the bridge noncontrolled rectifier. Other switching operations are performed in a similar way. Thus, in the system under consideration the switching of the transformer from one tapping to another is effected through the common LC-circuit 48, 49 during the time equal to the recharge time of the capacitor 49, the design power of the switching elements being by a factor $(n-1)$ lower than in the system with individual switching capacitors.

Figure 3:
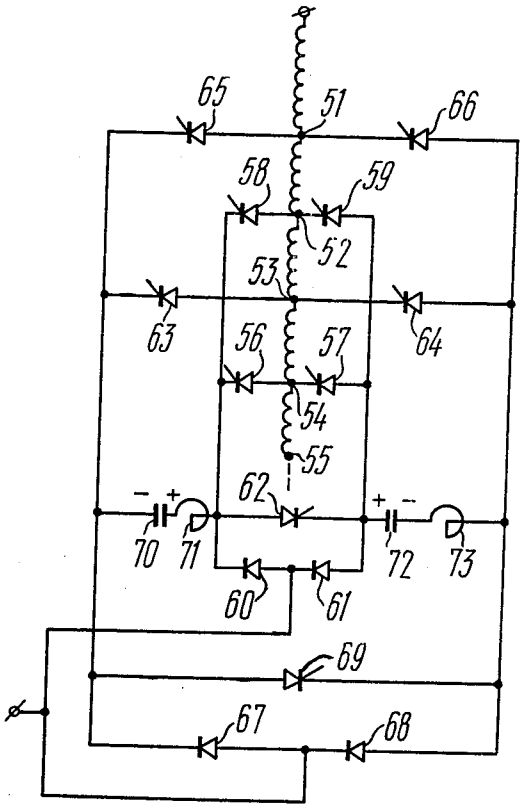
FIG. 3 shows an embodiment of the invention for a single-phase transformer or one phase of a three-phase transformer with a regulating zone in the center of the winding.

When the device is used for switching tappings of single phase transformers or three-phase transformers whose regulation zone is located in the center of the winding, the device may be made in the form shown in FIG. 3. FIG. 3 shows the regulation zone of a transformer winding having an arbitrary number of tappings, in this case five tappings 51–55. The thyristors 56, 57 or 58, 59 together with noncontrolled rectifiers 60, 61 form one single-phase bridge rectifier with a thyristor 62 in the d-c diagonal thereof. The second bridge rectifier is formed by thyristors 63, 64 or 65, 66 and noncontrolled rectifiers 67, 68, a thyristor 69 being inserted into the d-c diagonal of this bridge. The positive and negative terminals of the two bridges are connected through LC-circuits 70, 71 and 72, 73, respectively. Thus, the switch comprises two groups of bridge rectifiers, each group having two arms on noncontrolled rectifiers common for the whole transformer and two arms on thyristors to be connected in turn to the transformer tappings.

Under normal operating conditions the transformer is connected to one of the tappings 51–55 and the alternating current, e.g., when operating the tapping 53, flows through the circuit: the positive half-wave, tapping 53, thyristor 63, thyristor 69, noncontrolled rectifier 68, negative half-wave, noncontrolled rectifier 67, thyristor 69, thyristor 64, tapping 53. Under normal operating conditions the capacitors 70, 72 are charged to the amplitude value of the electromotive force of the tapping 53 with a polarity indicated in the drawing of FIG. 3.

The switching from the tapping 53 to the tapping 54 is effected in the following manner: the control pulses are fed to the thyristors 56, 57, 62. In this case back voltage is applied to the thyristor 69, said back voltage being provided by the charge of the capacitors 70, 72. The thyristor 69 is deenergized and further discharge of the capacitor is effected through the following circuit: the capacitor 70, reactor 71, thyristor 62, capacitor 72, reactor 73 and, conducting thyristors 63, 64. The reactors 70, 73 limit the increasing rate of the forward current and make it possible to obtain a time constant of the discharge of the switching capacitors sufficient for restoring the valve properties of the thyristor 69 for switching off action.

The control pulses from the thyristors 63, 64, i.e. from the thyristors of the energized tapping 53 are not removed during the period of the supply voltage, in which case the capacitors 70, 72 can be charged to the maximum value of the electromotive force of the tapping 53 with a polarity required for the subsequent switching.

Thus, the capacitor 70 is recharged during one half-wave through the following circuit: the tapping 53, thyristor 63, capacitor 70, reactor 71, thyristor 62, thyristor 57, and tapping 54. In another half-wave the capacitor 72 is recharged through the following circuit: the tapping 54, thyristor 57, thyristor 62, capacitor 72, reactor 73, thyristor 64, and tapping 53. After the capacitors have been charged and the control pulses are removed, the thyristors 63, 64 are switched off. At this stage the process of switching is over, the capacitors are charged for the next switching operation. Switching to the other tappings is effected in a similar way.

We claim:

1. A device for noncontact switching of loaded transformer tappings comprising: a plurality of bridge noncontrolled rectifiers the number of which is equal to the number of transformer tappings and to which said bridge noncontrolled rectifiers are connected, said bridge noncontrolled rectifiers having positive and negative d-c terminals; a switching thyristor connected between said negative and positive terminals of each of said bridge noncontrolled rectifiers to dispose the same in the d-c link of the respective bridge noncontrolled rectifier; and switching LC-circuits connected between the like terminals of said bridge noncontrolled rectifiers.

2. A device for noncontact switching of loaded transformer tappings, comprising: a plurality of bridge noncontrolled rectifiers the number of which is equal to the number of transformer tappings and to which said bridge noncontrolled rectifiers are connected, said bridge noncontrolled rectifiers having positive and negative d-c terminals; a first group of switching thyristors connected between said negative and positive d-c terminals of each of said bridge noncontrolled rectifiers; a second group of switching thyristors the anodes of which are connected to said positive terminals of said bridge noncontrolled rectifiers and the cathodes of which are combined; noncontrolled diodes the cathodes of which are connected to said bridge noncontrolled rectifiers and the anodes of which are combined; a switching LC-circuit connected between said combined cathodes of said second group of switching thyristors and said combined anodes of said noncontrolled diodes; and a thyristor shunting said switching LC-circuit.

3. A device for noncontact switching of loaded transformer tappings comprising: a first group of single-phase bridge rectifiers formed by two common arms formed of noncontrolled diodes and pairs of arms formed of thyristors, the number of said rectifiers being equal to half the number of transformer tappings; a second group of single-phase bridge rectifiers formed by two common arms formed of noncontrolled diodes and pairs of arms formed of thyristors the number of which is equal to half the number of transformer tappings, said first and second groups of single-phase bridge rectifiers having positive and negative d-c terminals; switching thyristors connected between said positive and negative terminals in each of said first and second groups of single-phase bridge rectifiers, said pairs of arms formed of thyristors of said first and second groups of single-phase bridge rectifiers alternately being connected to transformer tappings, and said arms formed of noncontrolled diodes of said first and second groups of bridge rectifiers being connected to the load; and switching LC-circuits connected to the like terminals of said first and second groups of single-phase bridge rectifiers.

* * * * *